US011270575B2

(12) United States Patent
Hermann

(10) Patent No.: US 11,270,575 B2
(45) Date of Patent: Mar. 8, 2022

(54) METHOD OF OPTICAL ALIGNMENT AND VERIFICATION OF FIELD OF VIEW INTEGRITY FOR A FLAME DETECTOR AND SYSTEM

(71) Applicant: CARRIER CORPORATION, Palm Beach Gardens, FL (US)

(72) Inventor: Theodore Hermann, Minneapolis, MI (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/734,173

(22) PCT Filed: Dec. 5, 2019

(86) PCT No.: PCT/US2019/064685
§ 371 (c)(1),
(2) Date: Dec. 1, 2020

(87) PCT Pub. No.: WO2020/118057
PCT Pub. Date: Jun. 11, 2020

(65) Prior Publication Data

US 2021/0287524 A1 Sep. 16, 2021

Related U.S. Application Data

(60) Provisional application No. 62/776,626, filed on Dec. 7, 2018.

(51) Int. Cl.
*G08B 29/18* (2006.01)
*G08B 17/12* (2006.01)

(52) U.S. Cl.
CPC ..... *G08B 29/183* (2013.01); *G08B 17/125* (2013.01)

(58) Field of Classification Search
CPC ..... G06K 9/00771; H04N 5/23296; H04N 5/23238; H04N 7/188; G08B 13/19628; G08B 17/125
See application file for complete search history.

(56) References Cited

U.S. PATENT DOCUMENTS 1,005,596 A 10/1911 Campbell
4,455,487 A 6/1984 Wendt
(Continued)

FOREIGN PATENT DOCUMENTS

CN 105931418 A 9/2016
GB 2459374 A 10/2009
(Continued)

OTHER PUBLICATIONS

International Search Report dated Feb. 17, 2020; International Application No. PCT/US2019/064685 International Filing Date Dec. 5, 2019 (7 pgs).
(Continued)

*Primary Examiner* — Mirza F Alam
(74) *Attorney, Agent, or Firm* — Cantor Colburn LLP

(57) ABSTRACT

A flame detector system (10) includes a flame detector (10) and a plurality of targets (22). The flame detector includes a housing (30), a flame sensor (32), an imaging device (34) having an optical view (70) that correlates to the field of view (50), and a controller (24) in communication with the imaging device. The plurality of targets are disposed within the optical view. The controller is programmed to operate the imaging device to capture a first image of an external environment (26) containing the plurality of targets and store the first image and a location of the plurality of targets within the first image.

15 Claims, 5 Drawing Sheets

(56) References Cited

U.S. PATENT DOCUMENTS

| | | | | |
|---|---|---|---|---|
| 6,078,050 | A | 6/2000 | Castleman | |
| 7,991,187 | B2 | 8/2011 | Hou | |
| 9,250,135 | B2 | 2/2016 | Cole et al. | |
| 9,459,142 | B1 | 10/2016 | Huseynov et al. | |
| 9,928,727 | B2 | 3/2018 | Harris et al. | |
| 2006/0188113 | A1* | 8/2006 | Tice | H04N 7/183 381/181 |
| 2009/0152479 | A1 | 6/2009 | Braendle | |
| 2011/0026014 | A1 | 2/2011 | Mack et al. | |
| 2011/0058037 | A1 | 3/2011 | Hanses et al. | |
| 2011/0304728 | A1 | 12/2011 | Owrutsky et al. | |
| 2014/0084166 | A1* | 3/2014 | Cole | G01J 1/08 250/342 |
| 2016/0156880 | A1* | 6/2016 | Teich | H04N 5/225 348/82 |
| 2017/0023402 | A1 | 1/2017 | Follett | |
| 2018/0316867 | A1* | 11/2018 | Mathur | H04N 5/44504 |
| 2019/0266869 | A1* | 8/2019 | Mills | G06K 9/6202 |

FOREIGN PATENT DOCUMENTS

| | | | |
|---|---|---|---|
| JP | 2003323681 | A | 11/2003 |
| JP | 2015108922 | A | 6/2015 |
| KR | 1020150134095 | A | 12/2015 |
| KR | 101767980 | B1 | 8/2017 |
| WO | 03102889 | A1 | 12/2003 |

OTHER PUBLICATIONS

Written Opinion dated Feb. 17, 2020; International Application No. PCT/US2019/064685; International Filing Date Dec. 5, 2019 (10 pgs).

* cited by examiner

METHOD OF OPTICAL ALIGNMENT AND VERIFICATION OF FIELD OF VIEW INTEGRITY FOR A FLAME DETECTOR AND SYSTEM

CROSS REFERENCE TO RELATED APPLICATIONS

This application claims the benefit of U.S. Application No. 62/776,626, filed on Dec. 7, 2018, which is incorporated herein by reference in its entirety.

BACKGROUND

Exemplary embodiments pertain to the art of fire detection systems.

Fire detection systems are provided to sense various attributes of a fire and provide a warning when a fire is detected. The fire detection system may be positioned in a hazardous location and have a specified field of view. The fire detection system also has the ability to see a specific size fire at a given distance within the field of view. However, objects may block the view of the fire detection system or the fire detection system may move out of position. To ensure proper performance of the fire detection system the integrity of the field of view should be maintained.

BRIEF DESCRIPTION

Disclosed is a flame detector system that includes a flame detector and a plurality of targets. The flame detector includes a housing, a flame sensor disposed in the housing and arranged to detect a flame within a field of view of the flame sensor, an imaging device disposed within the housing, the imaging device having an optical view that correlates to the field of view, and a controller in communication with the imaging device. The plurality of targets are external to the flame detector and are disposed within the optical view. The controller is programmed to operate the imaging device to capture a first image of an external environment containing the plurality of targets and store the first image and store a location of the plurality of targets within the first image.

In addition to one or more of the features described above, or as an alternative to any of the foregoing embodiments, the plurality of targets are selected natural features within the field of view.

In addition to one or more of the features described above, or as an alternative to any of the foregoing embodiments, the plurality of targets are installed targets placed within the field of view.

In addition to one or more of the features described above, or as an alternative to any of the foregoing embodiments, the imaging device is disposed coplanar with the flame sensor.

In addition to one or more of the features described above, or as an alternative to any of the foregoing embodiments, the controller is further programmed to operate the imaging device to capture a second image of the external environment containing the plurality of targets.

In addition to one or more of the features described above, or as an alternative to any of the foregoing embodiments, the second image is a real-time image of the external environment containing the plurality of targets.

In addition to one or more of the features described above, or as an alternative to any of the foregoing embodiments, the controller is further programmed to compare the plurality of targets present within second image to the stored plurality of targets present within the first image.

In addition to one or more of the features described above, or as an alternative to any of the foregoing embodiments, the controller is programmed to, output for display a warning, responsive to a positional difference between at least one target of the plurality of targets within the second image and at least one corresponding target of the plurality of targets within the first image being greater than a threshold.

In addition to one or more of the features described above, or as an alternative to any of the foregoing embodiments, the controller is programmed to, output for display a warning, responsive to at least one target of the plurality of targets within the second image not within the optical view.

Also disclosed is a flame detector that includes a plurality of flame sensors, an imaging device, and a controller. The plurality of flame sensors are disposed in a housing and arranged to detect a flame within a field of view of the flame sensors. The imaging device is disposed within the housing. The imaging device has an optical view that correlates to the field of view. The controller is in communication with the plurality of flame sensors and the imaging device. The controller is programmed to operate the imaging device to capture a first image of an external environment, identify a plurality of targets within the external environment within the first image, and storing a location of the plurality of targets associated with the first image.

In addition to one or more of the features described above, or as an alternative to any of the foregoing embodiments, the flame sensors are at least one of infrared sensors or ultraviolet sensors.

In addition to one or more of the features described above, or as an alternative to any of the foregoing embodiments, the controller is programmed to operate the imaging device to capture a real-time image of the external environment containing the plurality of targets.

In addition to one or more of the features described above, or as an alternative to any of the foregoing embodiments, the controller is programmed to compare a real-time location of the plurality of targets within the real-time image to the stored location of the plurality of targets associated with the first image.

In addition to one or more of the features described above, or as an alternative to any of the foregoing embodiments, the controller is programmed to output for display a warning, responsive to an error between the real-time location of the plurality of targets within the real-time image and the stored location of the plurality of targets associated with the first image being greater than a threshold.

Further disclosed is a method of optical alignment and verification of field of view integrity for a flame detector. The method includes capturing a first image of an external environment containing a plurality of targets with an imaging device provided with a flame detector having a flame sensor; identifying the plurality of targets within the first image; and storing the first image and a location of the plurality of targets within the first image.

In addition to one or more of the features described above, or as an alternative to any of the foregoing embodiments, the imaging device has an optical view that correlates to a field of view of the flame detector.

In addition to one or more of the features described above, or as an alternative to any of the foregoing embodiments, the method further includes capturing a second image of the external environment containing the plurality of targets; and comparing a location of the plurality of targets associated with the second image to the stored location of the plurality of targets associated with the first image.

In addition to one or more of the features described above, or as an alternative to any of the foregoing embodiments, the method further includes outputting for display a warning, responsive to a positional difference between the location of the plurality of targets within the second image and the stored location of the plurality of targets associated with the first image being greater than a threshold.

In addition to one or more of the features described above, or as an alternative to any of the foregoing embodiments, the method further includes moving the flame detector based on the positional difference to maintain the field of view associated with the first image.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
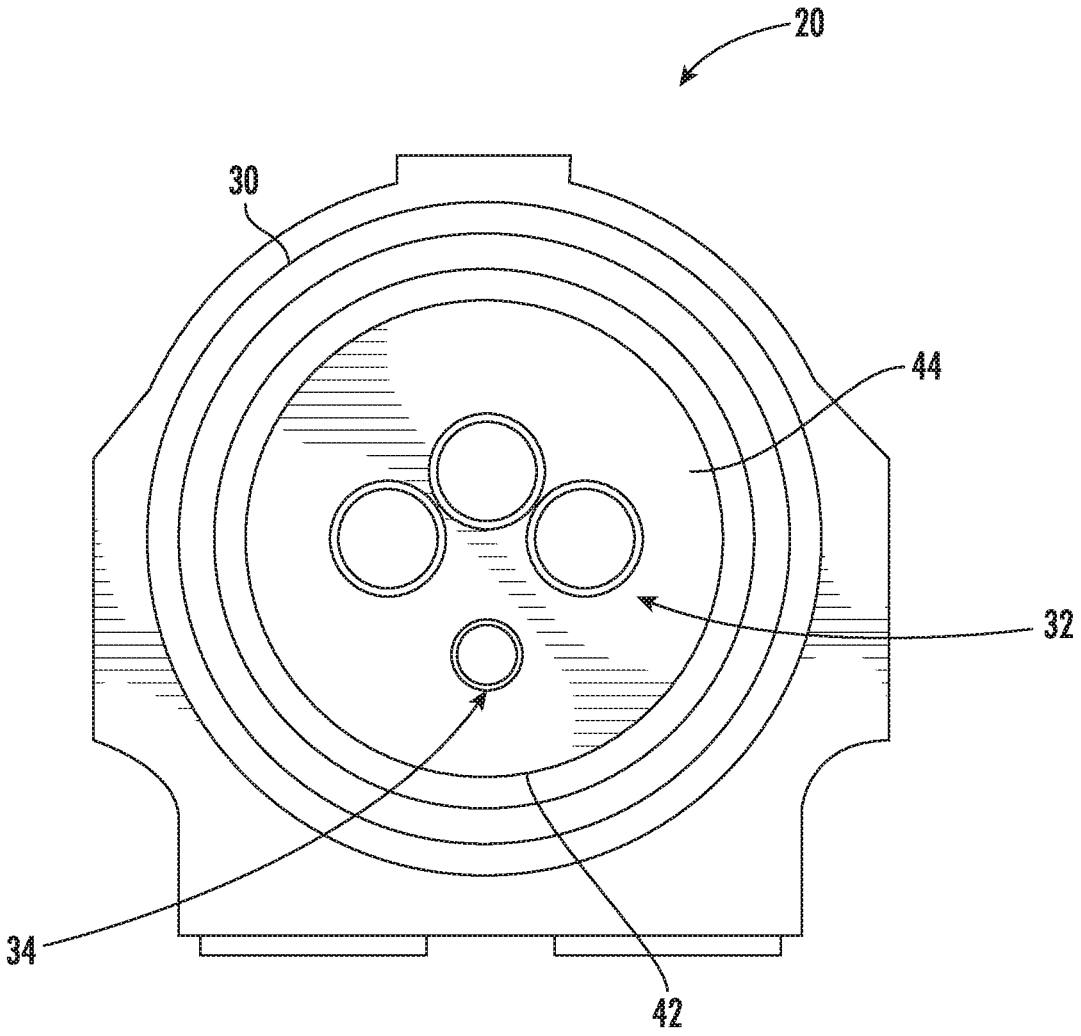
FIG. 1 is a view of a flame detector.
Figure 2:
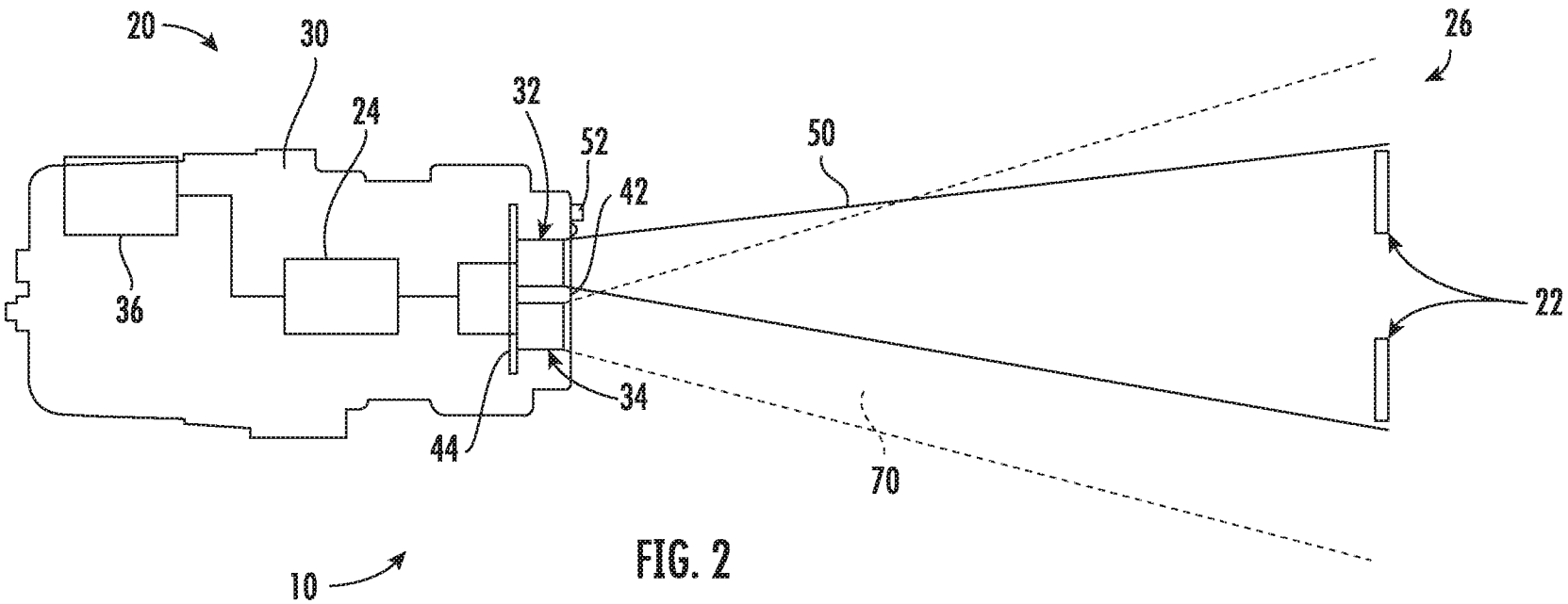
FIG. 2 is a block diagram of a flame detector system having the flame detector.

Referring to FIGS. 1 and 2, a flame detector system 10 is shown. The flame detector system 10 includes a flame detector 20, a plurality of targets 22 that are provided to verify optical alignment and/or field of view integrity of the flame detector 20, and a controller 24.

The flame detector 20 faces towards an external environment 26 and is arranged to detect a flame within the external environment 26. The flame detector 20 includes a housing 30, a plurality of flame sensors 32, an imaging device 34, and an output device 36.

Figure 3:
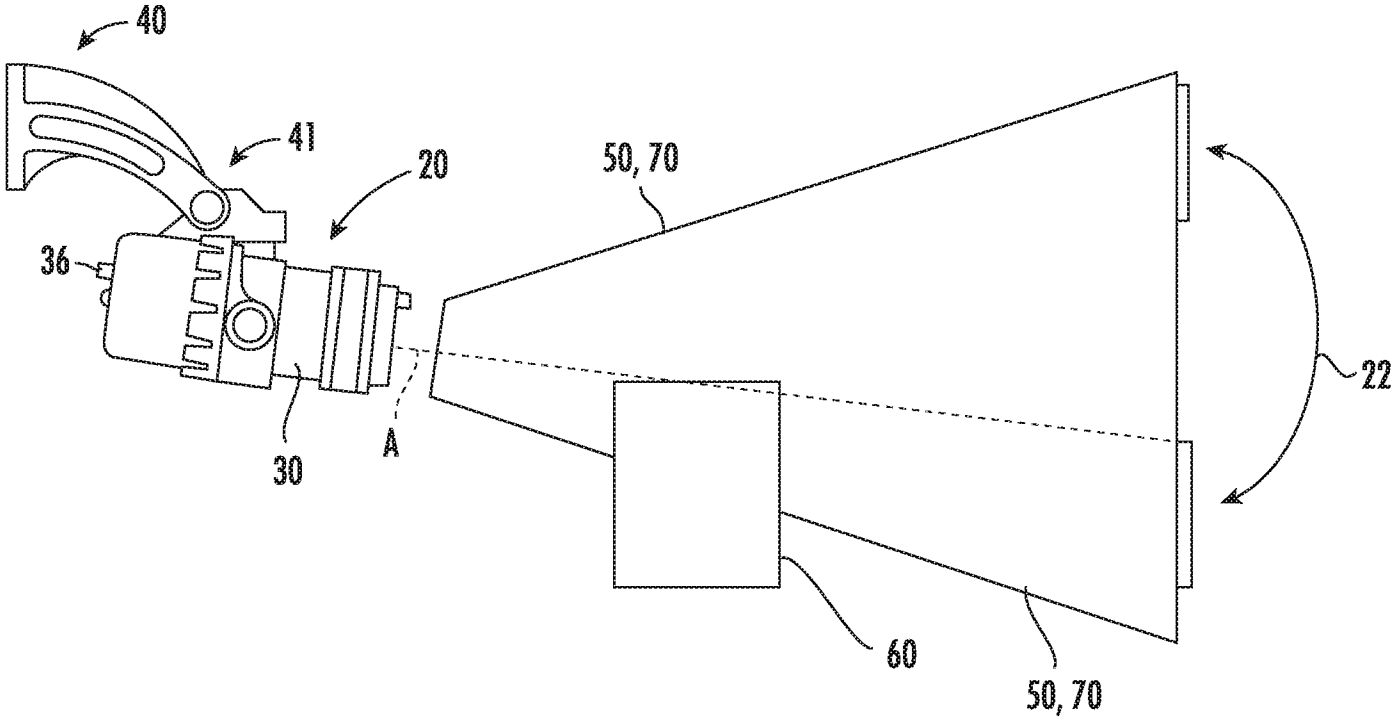
FIG. 3 is an illustration of the flame detector system having a field of view at least partially obstructed.

The housing 30 may be an explosion proof housing that is connected to a mounting bracket 40, as shown in FIG. 3. The mounting bracket 40 may be a swivel bracket or adjustable bracket that is arranged to facilitate the movement or positioning of the housing 30 of the flame detector 20 such that the flame detector 20 is facing or oriented relative to a detection area within the external environment 26. A feedback motor 41 may be provided with the mounting bracket 40 or may be provided between and connected to the mounting bracket 40 and the housing 30. The feedback motor 41 is arranged to move the housing 30 in a plurality of directions about or relative to a viewing axis A, or at least one pivot point based on data, signals, or commands provided by the controller 24 or a user through an interface device that is in communication with the controller 24.

Referring to FIGS. 1 and 2, the housing 30 has a closed end and an open end that may be at least partially sealed or enclosed by a window 42. The window 42 may be made of sapphire or the like that enables UV or IR radiation from a flame to enter into the housing 30 and potentially be detected by the plurality of flame sensors 32. The plurality of flame sensors 32 and the imaging device 34 are disposed within the housing 30 behind the window 42.

The plurality of flame sensors 32 may be disposed on a substrate 44 such as a printed circuit board that is disposed generally parallel to the window 42. The plurality of flame sensors 32 may be infrared sensors, IR pyroelectrics, ultraviolet sensors, combinations of the aforementioned sensors or other sensors capable of detecting the presence of a flame within the external environment 26. The plurality of flame sensors 32 may have or may define a field of view 50. The field of view 50 is an area, such as a detection area, within which the flame sensors 32 of the flame detector 20 may reliably detect the presence of a flame. The housing 30 may be provided with a field of view limiter 52 that is arranged to limit the field of view of at least one of the plurality of flame sensors 32 and/or the imaging device 34.

Figure 4:
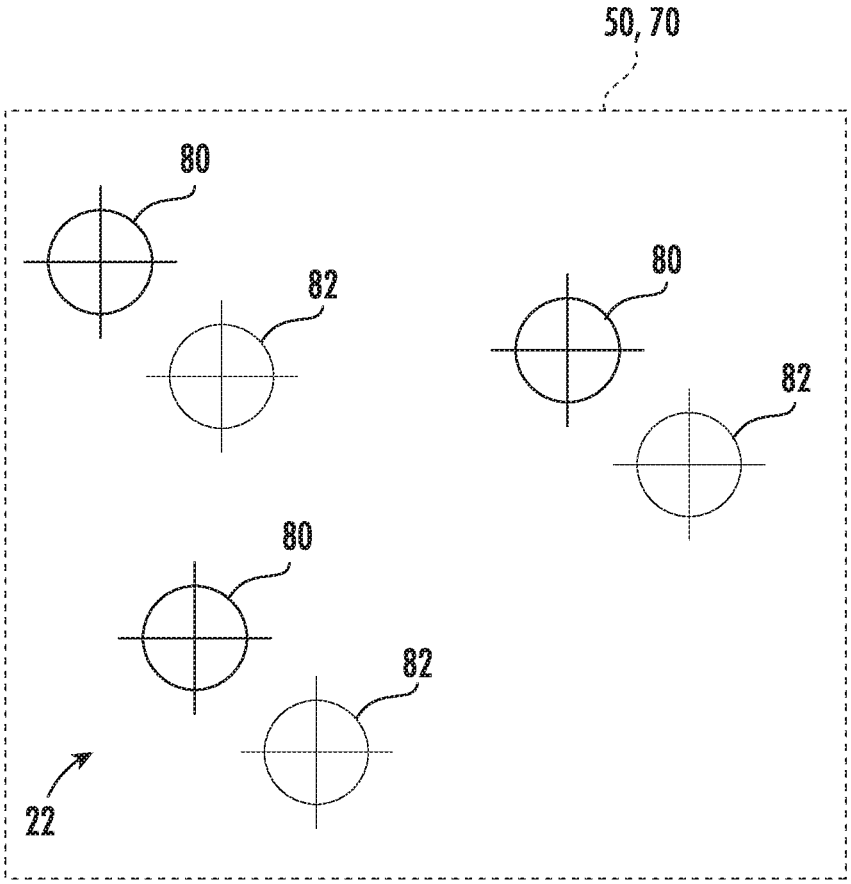
FIG. 4 is an illustration of the flame detector system having an alignment view.

Commonly, the integrity or cleanliness of the window 42 or other elements that make up the optical chain of the flame detector 20 may be checked by redirecting light energy back into the plurality of flame sensors 32. While this arrangement works to check the integrity of the optical path, the integrity issues with the field of view 50 may not be accurately verified using such a method. The integrity issues may include a dust cap or cover being disposed over the window 42, the mounting bracket 40 coming loose allowing the flame detector 20 to be incorrectly oriented, an obstruction 60 disposed within or interrupting the field of view 50 of the flame detector 20 (as shown in FIG. 3), shifting of the detection area without a corresponding shift of the field of view 50 of the flame detector 20 such that the flame detector is misaligned (as shown in FIG. 4), or other integrity issues. The imaging device 34 is integrated into the housing 30 of the flame detector 20 to enable the verification of the optical alignment of the flame detector 20 and field of view 50 of the flame detector 20.

Referring to FIGS. 1 and 2, the imaging device 34 is disposed on the substrate 44 such that the imaging device 34 is disposed coplanar with the flame sensors 32. The imaging device 34 is positioned to be generally coaxial with at least one flame sensor of the plurality of flame sensors 32 so as to provide the imaging device 34 with an optical field of view or an optical view 70 that correlates to the field of view 50 of the flame sensors 32. Correlation between the field of view 50 and the optical view 70 ensures that the view of the imaging device 34 (e.g. optical view) and the view of the flame sensors 32 (e.g. field of view 50) correspond such that they substantially overlap and provide generally co-extensive coverage. The co-extensive coverage or correlated views of the imaging device 34 and the flame sensors 32 are correlated to allow for accurate positioning of the flame detector 20 optically and ensures that the flame sensors 32 are aligned with the image data provided by the imaging device 34. The optical view 70 of the imaging device 34 may be larger than the field of view 50, as shown in FIG. 2, such that the field of view 50 is at least partially disposed within the optical view 70.

The imaging device 34 may be an optical camera, video camera, video imaging device or other device capable of taking or capturing an image (e.g. visible imaging or IR imaging) of the external environment 26 that corresponds to the overall field of view 50 of the flame sensors 32 or the detection coverage area of the flame detector 20. Should the imaging device 34 be capable of capturing IR images, the imaging device 34 and at least one flame sensor 32 may be one and the same.

The plurality of targets 22 are disposed external to the flame detector 20 and are disposed within the external environment 26. The plurality of targets 22 are disposed within the optical view 70 of the imaging device 34 that correlates to or corresponds to the field of view 50 of the flame sensors 32. The plurality of targets 22 may be disposed proximate a periphery of the optical view 70 of the imaging device 34 that correlates to or corresponds to the field of view 50 of the flame sensors 32, as shown in FIGS. 2 and 3. The plurality of targets 22 may be selected natural features within the external environment 26, such as immovable objects, fixtures, or the like. The plurality of targets 22 may be installed optical targets that are not natural features within the external environment 26. The installed optical targets may be disposed on immovable objects, fixtures, or other features within the external environment 26.

The plurality of targets 22 provide a reference(s) to enable the imaging device 34 of the flame detector system 10 to verify proper alignment of the flame detector 20 within the detection coverage area. The plurality of targets 22 also enables the flame detector system 10 to verify the field of view integrity of the flame detector 20.

The controller 24 is in communication with the plurality of flame sensors 32, the imaging device 34, and the output device 36. The controller 24 may be disposed within the housing 30 or may be a separately provided controller that may be provided as part of a monitoring system that is communication with the flame detector 20.

The controller 24 includes input communication channels that are arranged to receive data, signals, information, images, or the like from the plurality of flame sensors 32 and the imaging device 34. A signal conditioner or signal converter may be provided to condition the signal provided by the flame sensors 32 to the controller 24. The signal conditioner or single converter may be an analog to digital converter, a digital to analog converter, or another signal conditioner. A buffer may be provided to facilitate the comparison of images provided by the imaging device 34 to previously stored images of the external environment 26 containing the plurality of targets 22. The signal conditioner and the buffer may be provided with the controller 24 or may be provided as separate components that are in communication with the controller 24.

The controller 24 includes output communication channels that are arranged to provide data, signals, information, commands or the like to the flame sensors 32, the imaging device 34, and the output device 36. The controller 24 includes at least one processor that is arranged or programmed to perform a method of optical alignment and verification of the field of view integrity for the flame detector 20 based on inputs received from the imaging device 34.

Figure 5:
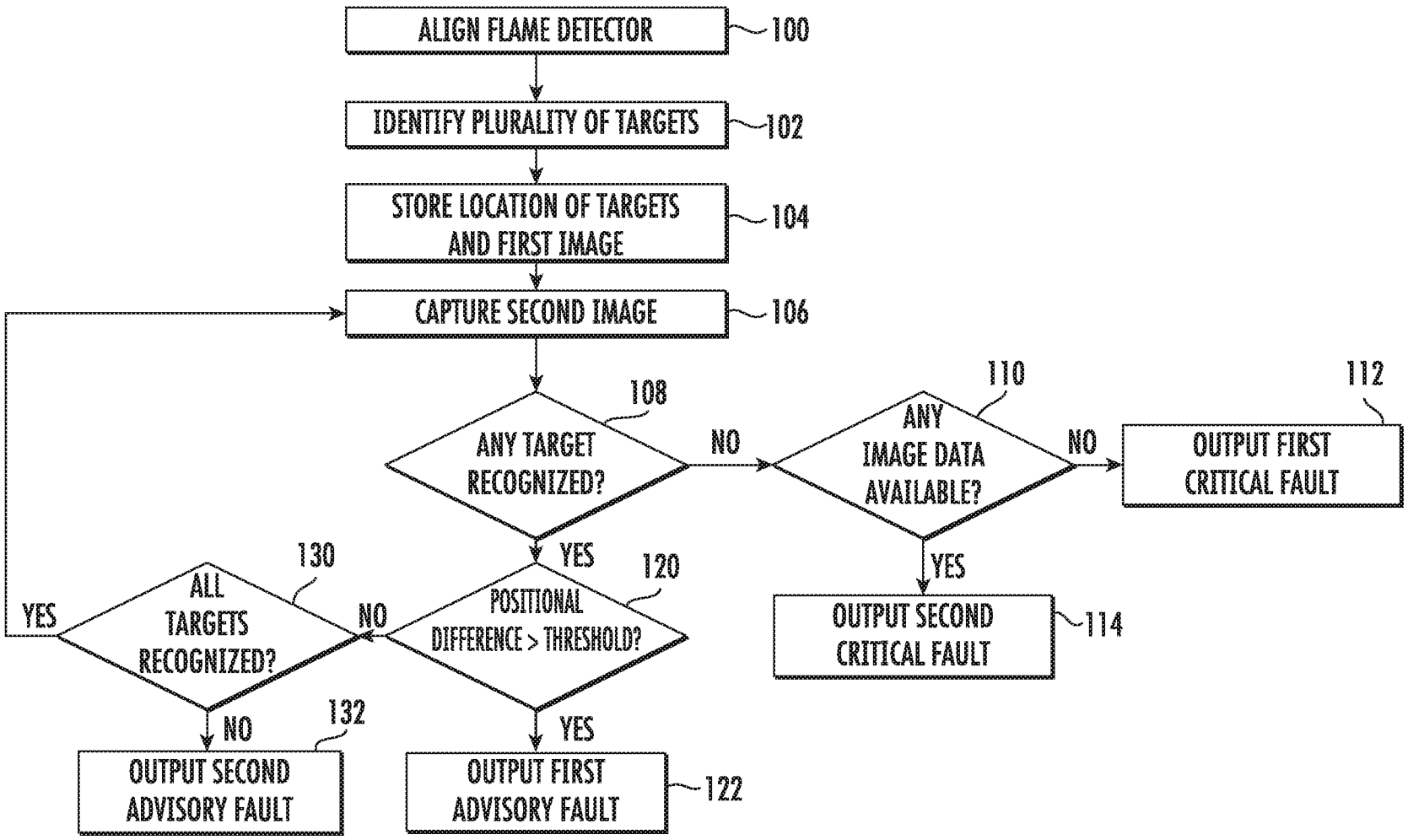
FIG. 5 is an illustrative method of optical alignment and verification of field of view integrity for the flame detector.

Referring to FIG. 5, with continued references to FIGS. 1-4, a method of optical alignment and field of view integrity verification for the flame detector 20 may be performed. The method enables the controller 24 to determine if the flame detector 20 is properly aligned with the initial detection coverage area (e.g. optical alignment) or if an obstruction 60 is present within the field of view 50 of the flame detector 20 (e.g. field of view integrity) through use of the imaging device 34. At block 100, the flame detector 20 is aligned or oriented towards a desired field of view. The aligning of the flame detector 20 towards the desired field of view may be based on image data (e.g. first image or reference image) captured by or provided by the imaging device 34 of the external environment 26 containing the plurality of targets 22, such that the desired field of view correlates to the optical view 70 of the imaging device 34. At block 102, the controller 24 is programmed to identify and/or locate the plurality of targets 22 within the optical view 70 that correlates to the field of view 50. At block 104, the reference image (e.g. first image) as well as the location of the plurality of targets 22 within the external environment 26 are stored within memory or storage means within or in communication with the controller 24. The location may be expressed in Cartesian coordinates, a 2-D map, or a 3-D map relative to the flame detector 20 or a base point. The stored first image and/or stored locations 80 of the plurality of targets 22 provides a baseline orientation or baseline optical alignment of the flame detector 20 during initial setup or installation of the flame detector 20.

At block 106, the controller 24 is programmed to command or operate the imaging device 34 to capture a second image or real-time image of the external environment 26 containing the plurality of targets 22. The second image may be captured after a predetermined or user-specified period of time, may be captured upon receipt of a request to verify the optical alignment and field of view integrity of the flame detector 20, or may be captured periodically. The second image may be a real-time image (e.g. video) of the external environment 26 expected to contain the plurality of targets 22 that may be within the optical view 70 that correlates to the field of view 50 or may be a still image of the external environment 26 expected to contain the plurality of targets 22 that may be within of the optical view 70 that correlates to the field of view 50. The second image is provided to the buffer to facilitate the comparison of the first image to the second image.

At block 108, the controller 24 determines if any targets of the plurality of targets 22 are present or recognized within the second image. Should no target of the plurality of targets 22 within the second image be present or recognized, the method may continue to block 110. At block 110, the method assess whether any image data is available within the second image, e.g. did the imaging device 34 capture any image of the external environment 26. Should no image of the external environment 26 be available, the method may continue to block 112 and output for display a first critical fault and disable the output device 36 from annunciating an alarm until the fault is corrected. The first critical fault may be indicative of the imaging device 34 being inoperative. If an image of the external environment 26 is available but no target of the plurality of targets 22 is present within the second image, the method may continue to block 114 and output for display a second critical fault and disable the output device 36 from annunciating an alarm until the fault is corrected. The second critical fault may be indicative of the optical view 70 of the imaging device or the field of view 50 of the flame sensors 32 being blocked or the flame detector 20 being completely misaligned.

Returning to block 108, if the controller 24 recognizes any target of the plurality of targets 22 within the second image, an optical image comparison between the second image and the first image may be performed by overlaying the first image and the second image or performing other image comparison methods. The controller 24 is programmed to compare the most recent location/position or the real-time location/position 82 of the plurality of targets 22 of the second image to the stored position/location 80 of the plurality of targets 22 of the first image. A positional difference may be determined between each target of the plurality of targets 22 present within the first image and a corresponding image of each target of the plurality of targets 22 present within the second image. The positional difference enables a determination of proper alignment of the flame detector 20 with the initial detection coverage area. As an example, the positional difference may be calculated to include a rotational error of the flame detector 20 about the viewing axis A and a positional error in Cartesian coordinates.

The proper alignment of the flame detector 20 may be assessed based on the error between the real-time location 82 of the plurality of targets 22 within the second image and the stored location 80 of the plurality of targets 22 within the first image. Referring to FIG. 4, the error may be determined due to an offset between the stored location 80 of the plurality of targets 22 within the first image and the real-time location 82 of the plurality of targets 22 within the second image being greater than a threshold error or threshold offset.

At block 120, the method determines if the positional difference is greater than a threshold positional difference between the stored position/location 80 of a target within the first image and the real-time location/position 82 of a corresponding second image of the same target within the second image. Should the positional difference (as shown in FIG. 4 as 80 and 82) be greater than the threshold positional difference, the method continues to block 122. At block 122, the method outputs a first advisory fault for display via the output device 36. The first advisory fault may be indicative of an alignment error of the flame detector 20 relative to the initial detection coverage area. An alarm may still be annunciated by the output device 36 if a threat is detected while the first advisory fault is present. In at least one embodiment, the controller 24 may determine an amount of positional difference based on Cartesian coordinates or other coordinate system and operate the feedback motor 41 to move the housing 30 based on the positional difference to align the flame detector 20 relative to the initial detection coverage area. The movement of the housing 30 by the feedback motor 41 may be moved automatically or may be moved by an operator.

Returning to block 120, if the positional difference between the stored position/location 80 of the target within the first image and the real-time location/position 82 of the corresponding second image of the same target within the second image is less than a threshold, the method continues to block 130. At block 130, the method determines if all of the targets of the plurality of targets 22 are recognized within the second image that correspond to all of the targets of the plurality of targets 22 within the first image. Should all of the targets of the plurality of targets 22 be recognized, the method may return to block 108. If at least one target of the plurality of targets 22 is present or recognized not within the second image an obstruction 60 may be present within the field of view 50 of the flame sensors 32 or within the optical view 70 of imaging device 34 and the method may continue to block 132. At block 132, the method outputs a second advisory fault for display via the output device 36. The second advisory fault may be indicative of a partial blockage of the field of view 50 by an obstruction 60. An alarm may still be annunciated by the output device 36 if a threat is detected while the second advisory fault is present. Referring to FIG. 3, an obstruction 60 may be present within the field of view 50 of flame detector 20, for example, should two targets of the plurality of targets 22 be identified and located within the first image and only one target of the two targets be identified and located within the second image.

The faults or indicators may be output for display via the output device 36. The output device 36 may be provided with the flame detector 20 or may be a separately provided output device 36. As shown in FIG. 2, the output device 36 may be provided with the housing 30 and may be an indicator light, an auditory device or the like that may at least partially extend through the housing 30.

The output device 36 may be commanded to output for display an indicator to notify a user or maintenance person as to a field of view fault for the scenario illustrated in FIG. 3. The controller 24 may be programmed to command the output device 36 to output for display an indicator to notify a user or maintenance person as to an alignment fault for the scenario illustrated in FIG. 4.

The flame detector system 10 of the present disclosure is arranged to verify optical alignment and field of view integrity for flame detection. The flame detector system 10 improves installation and setup efficiency of the flame detector 20 by avoiding the laborious laser alignment tasks by implementing a simpler image comparison technique to notifying an operator when realignment is needed. The flame detector system 10 avoids the current practice of periodic or scheduled maintenance by announcing when realignment or orientation of the flame detector 20 is necessary by running the optical alignment and field of view integrity method. The flame detector system 10 may also prevent false alarms and undeclared hazards due to misalignment of the flame detector 20 by notifying when misalignment of the flame detector 20 has occurred.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A flame detector system, comprising:

a flame detector, comprising:

a housing, a flame sensor disposed in the housing and arranged to detect a flame within a field of view of the flame sensor, an imaging device disposed within the housing, the imaging device having an optical view that correlates to the field of view, and a controller in communication with the imaging device; and a plurality of targets external to the flame detector and disposed within the optical view, the controller being programmed to operate the imaging device to capture a first image of an external environment containing the plurality of targets and store the first image and store a location of the plurality of targets in an initial detection coverage area within the first image;

the controller is further programmed to operate the imaging device to capture a second image of the external environment containing the plurality of targets;

wherein the controller is further programmed to compare a location of the plurality of targets present within the second image to the location of the plurality of targets present within the first image to determine if the flame detector is properly aligned with the initial detection coverage area.

2. The flame detector system of claim 1, wherein the plurality of targets are selected natural features within the field of view.

3. The flame detector system of claim 1, wherein the plurality of targets are installed targets placed within the field of view.

4. The flame detector system of claim 1, wherein the imaging device is disposed coplanar with the flame sensor.

5. The flame detector system of claim 1, wherein the second image is a real-time image of the external environment containing the plurality of targets.

6. The flame detector system of claim 1, wherein the controller is programmed to output for display a warning, responsive to a positional difference between at least one target of the plurality of targets within the second image and at least one corresponding target of the plurality of targets within the first image being greater than a threshold.

7. The flame detector system of claim 1, wherein the controller is programmed to output for display a warning, responsive to at least one target of the plurality of targets within the second image not within the optical view.

8. A flame detector, comprising:

a plurality of flame sensors disposed in a housing and arranged to detect a flame within a field of view of the flame sensors;

an imaging device disposed within the housing, the imaging device having an optical view that correlates to the field of view; and a controller in communication with the plurality of flame sensors and the imaging device, the controller being programmed to operate the imaging device to capture a first image of an external environment, identify a plurality of targets within the external environment within the first image, and storing a location of the plurality of targets in an initial detection coverage area associated with the first image;

the controller is further programmed to operate the imaging device to capture a second image of the external environment containing the plurality of targets;

wherein the controller is further programmed to compare a location of the plurality of targets present within the second image to the location plurality of targets present within the first image to determine if the flame detector is properly aligned with the initial detection coverage area.

9. The flame detector of claim 8, wherein the flame sensors are at least one of infrared sensors or ultraviolet sensors.

10. The flame detector of claim 8, wherein the controller is programmed to output for display a warning, responsive to an error between the real-time location of the plurality of targets within the real-time image and the stored location of the plurality of targets associated with the first image being greater than a threshold.

11. A method of optical alignment and verification of field of view integrity for a flame detector, comprising:

capturing a first image of an external environment containing a plurality of targets with an imaging device provided with a flame detector having a flame sensor, the plurality of targets located in an initial detection coverage area associated with the first image;

identifying the plurality of targets within the first image; and storing the first image and storing a location of the plurality of targets within the first image;

operating the imaging device to capture a second image of the external environment containing the plurality of targets;

comparing a location of the plurality of targets present within the second image to the location of the targets present within the first image to determine if the flame detector is properly aligned with the initial detection coverage area.

12. The method of claim 11, wherein the imaging device has an optical view that correlates to a field of view of the flame detector.

13. The method of claim 11, further comprising:

outputting for display a warning, responsive to a positional difference between the location of the plurality of targets within the second image and the stored location of the plurality of targets associated with the first image being greater than a threshold.

14. The method of claim 13, further comprising:

moving the flame detector based on the positional difference to maintain the field of view associated with the first image.

15. The flame detector system of claim 1, wherein the plurality of targets are permanent targets at a fixed location.

* * * * *